US006123160A

United States Patent [19]

Tibbitts

[11] Patent Number: 6,123,160

[45] Date of Patent: Sep. 26, 2000

[54] DRILL BIT WITH GAGE DEFINITION REGION

[75] Inventor: Gordon A. Tibbitts, Salt Lake City, Utah

[73] Assignee: Baker Hughes Incorporated, Houston, Tex.

[21] Appl. No.: 08/832,051

[22] Filed: Apr. 2, 1997

[51] Int. Cl.[7] ..... E21B 10/46

[52] U.S. Cl. ..... 175/385; 175/406; 175/408

[58] Field of Search ..... 175/406, 408, 175/391, 385, 393, 394

[56] References Cited

U.S. PATENT DOCUMENTS

| | | | |
|---|---|---|---|
| 1,084,871 | 1/1914 | Tuck | 175/394 |
| 1,547,459 | 7/1925 | Stafford et al. | 175/391 |
| 1,701,427 | 2/1929 | Shields | 175/391 |
| 1,907,154 | 2/1933 | Mitchell | 175/391 |
| 2,738,167 | 3/1956 | Williams, Jr. . | |
| 2,838,286 | 6/1958 | Austin . | |
| 3,135,341 | 6/1964 | Ritter . | |
| 3,220,497 | 11/1965 | Mori . | |
| 3,367,430 | 2/1968 | Rowley . | |
| 3,825,083 | 7/1974 | Flarity et al. . | |
| 3,945,447 | 3/1976 | Peterson . | |
| 4,031,974 | 6/1977 | Peterson . | |
| 4,091,884 | 5/1978 | Thomas | 175/395 |
| 4,098,363 | 7/1978 | Rhode et al. . | |
| 4,234,048 | 11/1980 | Rowley . | |
| 4,351,401 | 9/1982 | Fielder . | |
| 4,352,400 | 10/1982 | Grappendorf et al. . | |
| 4,512,426 | 4/1985 | Bidegaray . | |
| 4,515,226 | 5/1985 | Mengel et al. . | |
| 4,515,227 | 5/1985 | Cerkovnik . | |
| 4,550,790 | 11/1985 | Link . | |
| 4,552,231 | 11/1985 | Pay et al. . | |
| 4,586,574 | 5/1986 | Grappendorf . | |
| 4,635,738 | 1/1987 | Schillinger et al. . | |
| 4,848,489 | 7/1989 | Deane . | |
| 4,848,491 | 7/1989 | Burridge et al. . | |
| 4,869,330 | 9/1989 | Tibbitts . | |
| 4,981,183 | 1/1991 | Tibbitts . | |
| 4,986,375 | 1/1991 | Maher | 175/323 |
| 5,004,057 | 4/1991 | Tibbitts et al. . | |
| 5,163,524 | 11/1992 | Newton, Jr. et al. . | |
| 5,178,222 | 1/1993 | Jones et al. . | |
| 5,314,033 | 5/1994 | Tibbitts . | |
| 5,341,888 | 8/1994 | Deschutter . | |
| 5,361,859 | 11/1994 | Tibbitts . | |
| 5,425,288 | 6/1995 | Evans . | |
| 5,456,328 | 10/1995 | Saxman . | |
| 5,467,836 | 11/1995 | Grimes et al. . | |
| 5,495,899 | 3/1996 | Pastusek et al. . | |
| 5,641,027 | 6/1997 | Foster | 175/385 |
| 5,678,644 | 10/1997 | Fielder . | |
| 5,697,461 | 12/1997 | Newton et al. | 175/408 |

FOREIGN PATENT DOCUMENTS

| | | | |
|---|---|---|---|
| 994677 | 2/1983 | U.S.S.R. | 175/385 |
| 1196765 | 7/1970 | United Kingdom | 175/391 |

OTHER PUBLICATIONS

Description of Norton Christensen drill bits—early 1980t3 s (5 pages).

*Primary Examiner*—Hoang Dang
*Attorney, Agent, or Firm*—Trask, Britt & Rossa

[57] ABSTRACT

A drill bit and method of drilling employing a gage definition region on the bit to relatively gradually and incrementally increase the diameter of the borehole being drilled from a diameter that is cut by fixed face cutters or rolling cone cutters on the bit body to a larger diameter. Preferably, the diameter of the gage definition region defined by cutting structures thereon varies along a longitudinal length of the bit, being smallest nearest the leading end of the bit. In a preferred embodiment, the gage definition region includes a plurality of helically arranged cutting elements disposed around the perimeter of the gage definition region. Such a configuration of cutting elements helps to reduce the loading on, and wear of, each individual cutting element. Thus the effective life of the bit is extended by enhancing its ability to drill the borehole to the gage diameter over a longer interval than may be achieved with conventional bit designs.

20 Claims, 13 Drawing Sheets

DRILL BIT WITH GAGE DEFINITION REGION

BACKGROUND OF THE INVENTION

1. Field of the Invention

This invention relates generally to rotary drill bits used in drilling subterranean wells and, more specifically, to drill bits having a gage definition portion or region that relatively gradually expands the diameter of the wellbore from that cut by the face cutters to substantially the full gage diameter of the bit.

2. State of the Art

The equipment used in drilling operations is well known in the art and generally comprises a drill bit attached to a drill string, including drill pipe and drill collars. A rotary table or other device such as a top drive is used to rotate the drill string, resulting in a corresponding rotation of the drill bit. The drill collars, which are heavier per unit length than drill pipe, are normally used on the bottom part of the drill string to add weight to the drill bit, increasing weight on bit (WOB). The weight of these drill collars presses the drill bit against the formation at the bottom of the borehole, causing it to drill when rotated. Downhole motors are also sometimes employed, in which case the bit is secured to the output or drive shaft of the motor.

A typical rotary drill bit includes a bit body, with a connecting structure for connecting the bit body to the drill string, such as a threaded portion on a shank extending from the bit body, and a crown comprising that part of the bit fitted with cutting structures for cutting into an earth formation. Generally, if the bit is a fixed-cutter or so-called "drag" bit, the cutting structures include a series of cutting elements made of a superabrasive material, such as polycrystalline diamond, oriented on the bit face at an angle to the surface being cut (i.e., side rake, back rake).

Various manufacturing techniques known in the art are utilized for making such a drill bit. In general, the bit body may typically be formed from a cast or machined steel mass or a tungsten carbide matrix cast by infiltration with a liquified metal binder onto a blank which is welded to a tubular shank. Threads are then formed onto the free end of the shank to correspondingly match the threads of a drill collar.

Cutting elements are usually secured to the bit by preliminary bonding to a carrier element, such as a stud, post or elongated cylinder, which in turn is inserted into a pocket, socket or other aperture in the crown of the bit and mechanically or metallurgically secured thereto. Specifically, polycrystalline diamond compact (PDC) cutting elements, usually of a circular or disc-shape comprising a diamond table bonded to a supporting WC substrate, may be brazed to a matrix-type bit after furnacing. Alternatively, freestanding (unsupported) metal-coated thermally stable PDCs (commonly termed TSPs) may be bonded into the bit body during the furnacing process used to fabricate a matrix-type drill bit.

A TSP may be formed by leaching out the metal in the diamond table. Such TSPs are suitable for the aforementioned metal coatings, which provide a metallurgical bond between the matrix binder and the diamond mass. Alternatively, silicon, which possesses a coefficient of thermal expansion similar to that of diamond, may be used to bond diamond particles to produce an Si-bonded TSP which, however, is not susceptible to metal coating. TSPs are capable of enduring higher temperatures (on the order of 1200° C.) used in furnacing matrix-type bits without degradation in comparison to normal PDCs, which experience thermal degradation upon exposure to temperatures of about 750–800° C.

The direction of the loading applied to the radially outermost (gage) cutters is primarily lateral. Such loading is thus tangential in nature, as opposed to the force on the cutters on the face of the bit which is substantially provided by the WOB and thus comprises a normal force substantially in alignment with the longitudinal bit axis. The tangential forces tend to unduly stress even cutters specifically designed to accommodate this type of loading and high bounce rates, due to the relatively large depths of cut taken by cutters employed to define the gage of the borehole and the stress concentrations experienced by the relatively small number of cutters assigned the task of cutting the gage diameter. It should be realized that, for any given rotational speed of a bit, the cutters proximate the gage area of the bit are traveling at the highest velocities of any cutters on the bit due to their location at the largest radii. Such cutters also traverse the longest distances during operation of the bit. Therefore, their velocity plus their distance traveled, and the large sideways or lateral resistive loads encountered by the cutters, which loads may be equivalent to those at the center of the bit face, may overwhelm even the most robust, state-of-the-art superabrasive cutters. While the radially outermost cutting elements on the bit face, referred to as gage cutters, typically have a flattened or linear radially outer profile aligned parallel to the longitudinal axis of the bit to reduce cutter exposure and cut a precise gage diameter through the borehole, such profiles actually enhance or speed up wear due to the large contact areas, which generate excessive heat. Wear of the gage cutters may, over time, result in an undergage wellbore.

In a typical bit arrangement, the gage of the bit is that substantially cylindrical portion located adjacent to and extending above the gage cutters longitudinally along the bit body at a given radius from the bit centerline. In a slick gage arrangement, such as that shown in U.S. Pat. No. 5,178,222, the radius of the gage is essentially the same as the outer diameter defined by the gage cutters.

During drilling as the bit penetrates into a formation, a typical slick gage drill bit will drill the borehole diameter with the gage cutters, the gage of the bit then snugly passing therethrough. Even when the gage cutters extend a substantial radial distance beyond the gage of the bit from the bit centerline, as the gage cutters wear and the diameter of the wellbore consequently decreases to become closer to that of the bit gage, greater frictional resistance by the gage against the wall of the wellbore will be experienced. As a result, the rate of penetration (ROP) of the drill bit will continually decrease, requiring more WOB until the gage cutters may degrade to a point where the ROP is unacceptable. At that point, the worn bit must be tripped out of the borehole and replaced with a new one, even though the face cutting structure may be relatively unworn.

One way known in the art to lengthen the life of the drill bit is to provide cutting elements on the gage of the bit. For example, U.S. Pat. No. 5,467,836 discloses a drill bit having gage inserts that provide an active cutting gage surface that engages the sidewall of the borehole to promote shearing removal of the sidewall material. U.S. Pat. No. 5,004,057 illustrates a drill bit having both an upper and lower gage section having gage cutting portions located thereon. Other prior art bits include both abrasion resistant pads and cutters on the gage of the bit, such as the bit disclosed in U.S. Pat. No. 5,163,524.

The bits disclosed in the aforementioned references, however, do not provide a gage definition region that relatively, gradually and incrementally expands the diameter of the wellbore from that cut by the face of the bit to the gage diameter. Thus, it would be advantageous to provide variously configured definitional cutting regions having cutting structures arranged thereon to maintain the ROP and/or accommodate various ROPs of the drill bit through a formation and reduce the loads applied to any one cutter whether in the region or at the definitional gage diameter of the bit.

Cutting elements of a fixed-cutter drill bit have typically been arranged along the lower edges of longitudinally extending blades, each cutting element being positioned at a different radial location relative to the longitudinal axis of the bit. An exemplary arrangement of cutting elements is illustrated in U.S. Pat. No. 5,178,222 to Jones et al. and assigned to the assignee of the present invention. In FIG. 4 of the patent, all the cutting elements of the bit are shown, illustrating their horizontal overlapping paths upon rotation of the bit. Upon one complete rotation of the bit, it has been believed, by having the cutting elements arranged in such an overlapping configuration, a substantially uniform layer of material from the bottom of the wellbore can be removed, the thickness of the layer and the rotational speed of the bit determining the ROP.

While other blade orientations have been considered, including spiral blades such as those found on the drill bit illustrated in U.S. Pat. No. 4,848,489 to Deane, the cutting elements of such a bit have been arranged with regard to substantially the same horizontal plane (i.e., perpendicular to the longitudinal axis of the bit) and thus to horizontally overlap upon rotation of the drill bit. In sum, prior art bits have been designed in a two-dimensional framework with cutting elements positioned and oriented to cut the formation upon rotation of the bit without consideration of the effects of the vertical movement of the bit into the formation. Additionally, this two-dimensional framework has resulted in gage cutters being spaced and positioned in a similar manner to cutters on the bit face.

U.S. Pat. No. 5,314,033 to Tibbitts, herein incorporated by reference and assigned to the assignee of the present invention, recognized that the path of each cutting element on a drill bit follows a helical path into the formation and that the angle of the helical path affects the effective rake angle of the cutter. Accordingly, the cutting elements were attached to the face of the bit at various back rake angles, depending on their position on the bit face, taking into account their effective rake angle, and cooperatively associated with at least one other cutter to enhance the cooperative cutting of the cutting elements.

Recognizing that the path of the cutting elements into the formation is helical in nature, the aforementioned patent teaches how this helical path affects the actual or effective rake angle of the cutting elements. Such path also, however, affects the loading of each cutting element, depending on the cutter's position relative to the longitudinal axis of the bit. Thus, it would be desirable to provide a drill bit having cutting elements in the outer radius area of the bit body arranged to effectively reduce the stresses experienced by each cutting element at or near the gage diameter of the bit by incrementally cutting the outermost portion of the wellbore to full gage diameter using a relatively large number of cutters, each taking a small depth of cut. Such a drill bit would result in longer cutting element life by reducing individual wear and decreasing the rate of cutter failure and/or wear in the gage region of the bit.

SUMMARY OF THE INVENTION

The present invention provides a rotary-type drill bit having cutting elements generally arranged intermediate what have conventionally been called the face and/or the gage portions of the bit. More specifically, the bit includes cutting elements arranged in a gage definition region by which the cutting elements relatively, gradually expand the diameter of the wellbore being cut from that cut by the face cutters to the gage diameter of the bit. Preferably, these cutting elements are arranged so that their cutting edges form a relatively gradually expanding cutting diameter, each of the cutting elements nibbling away at the formation in small increments from the diameter cut by face cutters to or near the gage diameter.

In a preferred embodiment, the cutting elements in the gage definition region are helically arranged at an angle or pitch relative to the centerline of the bit, preferably corresponding to an angle or pitch or range of angles or pitches of a helix generated by the cutting elements upon rotation of the bit at a given rate of penetration into a formation. In addition, the helix formed by the cutting edge of the cutting elements varies in diameter to form a spiral (looking down the longitudinal axis of the bit), being smallest in diameter nearest the distal or leading end of the bit and relatively gradually radially expanding toward the proximal or traling end of the bit. In addition, there may preferably be one or more series of cutting elements forming one or more helices and/or spirals around the bit, like multiple leads on a multi-lead screw.

In another preferred embodiment, the diameter of the bit formed by the cutting edges of a series of cutting elements in a gage definition region is varied by varying the depth into the bit in which each of the similarly configured cutting elements is set. Preferably, the diameter of the bit in the definition region is smallest at the leading end of the bit and gradually increases in diameter from one cutting element to the next.

In another preferred embodiment, a longitudinal section of the bit body comprising a gage definition region and having cutting elements arranged thereon varies in diameter, the longitudinal section comprising the gage definition region being smallest in diameter nearest the leading or face end of the bit and increasing in diameter toward the trailing or shank end of the bit.

In another preferred embodiment, a gage area according to the present invention may comprise both a slick gage region and a gage definition region. More specifically, an upper, slick gage region may include a plurality of tungsten carbide inserts positioned about the perimeter of the gage and a lower, gage definition region may include a plurality of helically- and/or spirally-positioned polycrystaline diamond or other superabrasive cutters. The gage definition region may be helically oriented about the circumference of the bit, forming a continuous helix extending completely therearound for one or more revolutions. The gage definition region may also be oriented in a changing or variable helical angle or pitch to accommodate various ROPs and/or revolutions per minute (RPM) of the bit. In either case, the gage definition region gradually cuts the gage of the borehole. In some cases, the gage definition region may entirely occupy what conventionally has been called the gage section or area of the bit body. Additionally, the blades of the bit extending through the gage definition region according to the present invention may preferably be arranged substantially parallel with respect to the longitudinal axis of the bit, or be helically configured around the perimeter of the bit gage.

In still another preferred embodiment, the "gage" area of the bit includes a plurality of gage regions, each having a different function, as for cutting, steering, etc. For example, the gage may include a series of gage regions including one or more gage definition regions. More specifically, the gage may include a gage definition region followed by a slick gage region and another gage definition region. Likewise, the gage may include a gage definition region followed by a gage recess followed by a slick gage region.

The invention may also be characterized in terms of a method and apparatus for cutting a wellbore to a diameter substantially approaching the gage diameter with the cutting elements on the bit face in a conventional manner, while the remaining, minor portion of diameter is cut by a longitudinally-extending gage definition region employing a plurality of mutually-cooperative cutting elements, each taking a small depth of cut until gage diameter is achieved. It is contemplated that, at most, the wellbore diameter will be enlarged a total of about one inch (2.54 cm), or one-half inch (1.27 cm) taken radially from the centerline of the bit, with the gage definition region. Preferably, the wellbore diameter will be enlarged a maximum of 0.100–0.200 inches (0.254–0.508 cm), or 0.050–0.100 inches (0.127–0.254 cm) from the centerline, over a series of small incremental cuts, according to the invention. The depth of cut taken by each of the plurality of cutters in the gage definition region may range from as little as 0.001–0.002 inches (0.00254–0.00508 cm) in particularly hard formations or softer formations exhibiting hard stringers to 0.010 to 0.015 inches (0.0254–0.1026 cm) in softer formations. The harder or stringer-bearing formations are also typically cut with a larger number of cutters.

The foregoing and other objects, features and advantages of the invention will become more readily apparent from the following detailed description of the preferred embodiments, which proceeds with reference to the drawings.

DETAILED DESCRIPTION OF THE ILLUSTRATED EMBODIMENT

Figure 1:
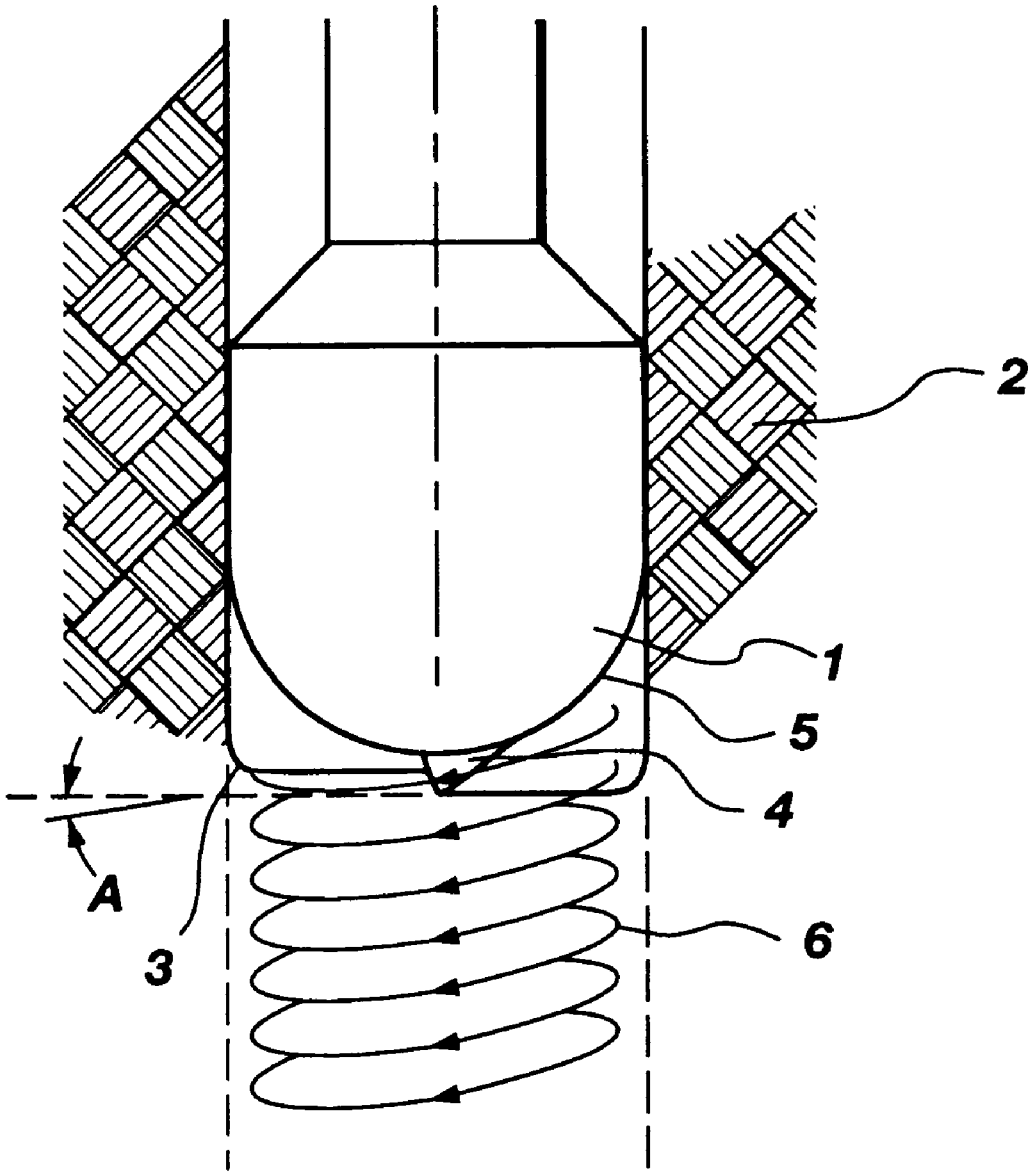
FIG. 1 is a schematic conceptual illustration of a drill bit rotating and moving downward into a subterranean formation as a borehole is cut therein.

As conceptually shown in FIG. 1, since a drill bit 1 is rotating and moving downward into the formation 2 as the borehole 3 is cut, the cutting path followed by an individual cutter 4 on the surface 5 of the bit 1 follows a helical path downwardly spiraling at an angle A relative to the horizontal, the path being illustrated by solid line 6 extending down the borehole 3 into the formation 2. For example, a bit 1 having a cutter 4 rotating in a radius of six inches, at a drilling rate of ten feet per minute, and a rotational speed of 50 revolutions per minute results in the helical path 6 having an angle A of inclination relative to horizontal of approximately 4°. While bit 1 is shown having a single cutter 4 affixed on the exterior surface 5 of the drill bit 1, it should be understood that a bit typically employs numerous cutters. For the purposes of illustrating the helical path 6 followed by an individual cutter 4 on bit 1, only a single cutter 4 has been illustrated.

Figure 2:
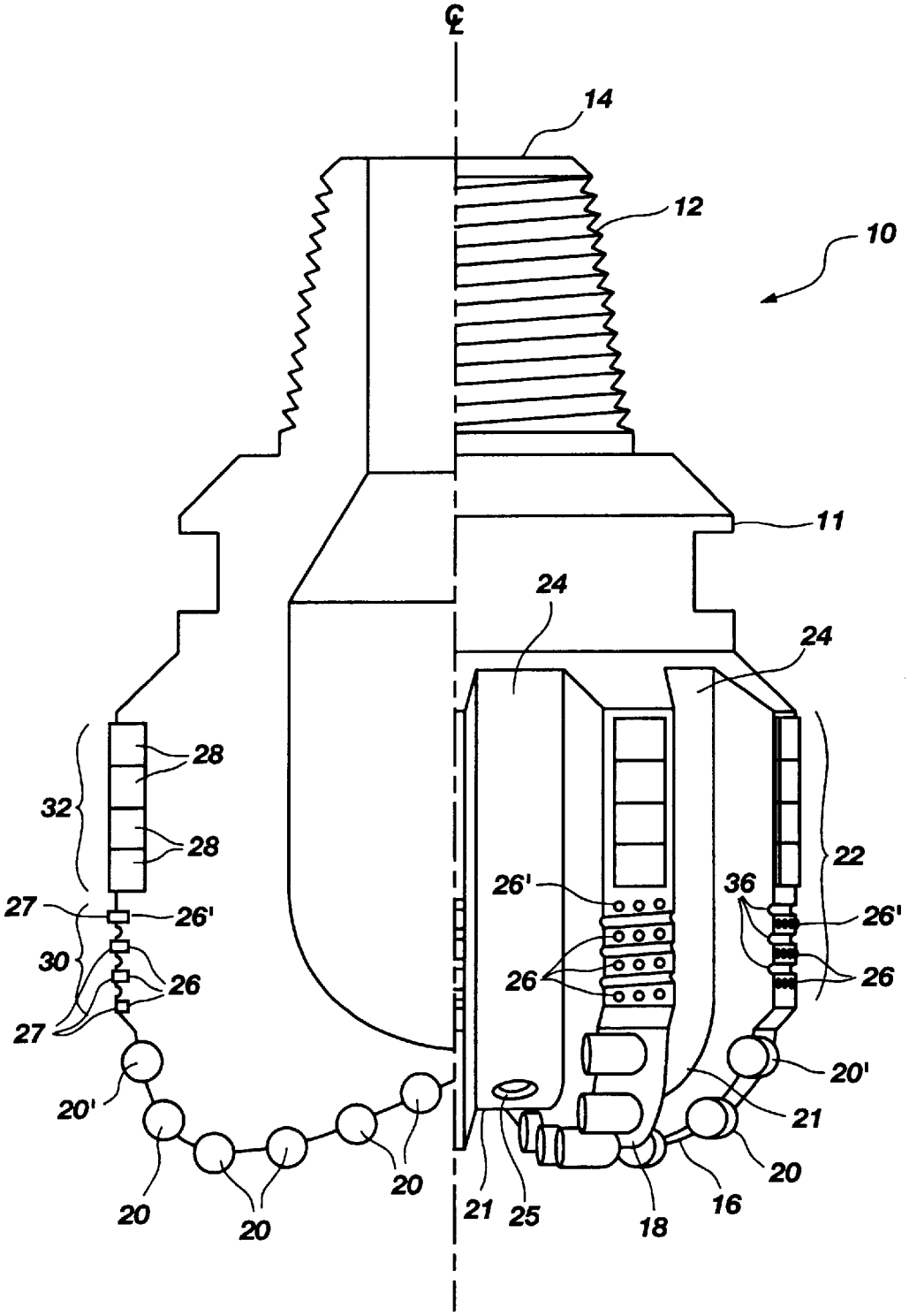
FIG. 2 is a part cross-sectional/part side view of a first embodiment of a drill bit in accordance with the present invention.

FIG. 2 shows a rotary drill bit 10 having a generally cylindrical bit body 11 in accordance with the present invention. The drill bit 10 has a connecting structure 12 at a proximal or trailing end 14 for attachment to a drill string by a collar or other methods as known in the art. At a distal or leading end 16 of the drill bit 10 is the face 18 to which a plurality of face cutters 20 may be attached. What has conventionally been called the gage of the bit 10 extends upwardly from the face 18 as gage area 22, which ultimately defines the diameter of the hole to be drilled with such a bit 10.

The bit 10 may also include a plurality of junk slots 24 longitudinally extending from the face 18 of the bit body 11 through the gage area 22. The junk slots 24 allow drilling fluid jetted from nozzle ports 25 and cuttings generated during the drilling process to flow upwardly between the bit 10 and the wellbore wall. As shown, these junk slots 24 may communicate with face passages 21 adjacent the cutters 20 such that formation cuttings may flow from the cutters 20 via face passages 21 directly into the junk slots 24, carried by drilling fluid emanating from nozzles in the bit face.

According to the present invention, the gage area 22 is comprised of a gage definition region 30 including a plurality of cutting elements 26 and a slick gage region 32 including a plurality of gage pads 28. In this embodiment, the cutting elements 26 of the gage definition region 30 are helically arranged around the perimeter of the gage area 22. The cutting edges 27 of the cutting elements 26 gradually increase in radial distance from the centerline CL of the bit 10, those cutting edges 27 nearest the leading end 16 of the bit 10 being closest to the bit 10 centerline. Cutting elements 26 may comprise PDC, TSP, cubic boron nitride, natural diamond, synthetic diamond grit (in the matrix or in impregnated cutter form), or any other suitable materials known in the art. The gage definition region 30 reduces the stress that would otherwise be placed on the outermost face cutters 20' as conventionally employed as a "gage" cutter by gradually enlarging the wellbore to its final or gage diameter from the diameter cut by the face cutters 20. Thus, even radially outermost face cutters 20' undergo primarily normal forces, rather than the destructive tangential forces experienced when conventional cutter exposures and depths of cut are used with cutters at the periphery of the bit face to define the gage diameter of the bit. Stated another way, the helical configuration of the gage definition region 30 provides necessary cutter redundancy to gradually and incrementally expand the diameter of the wellbore to gage diameter from an initial diameter and by cutters on the bit face rather than taking relatively large cuts with the outermost face cutters 20'. As illustrated, the gage definition region 30 includes several rows of cutting elements 26 with slots 36 similarly helically interposed between each row of cutting elements 26. Adjacent to and above the gage definition region 30, the slick gage region 32 includes a plurality of substantially rectangular gage pads 28 that may also be comprised of other shapes such as circles, triangles and the like, as known in the art. Pads 28 may be comprised of tungsten carbide inserts or other abrasion- and erosion-resistant materials known in the art. The pads 28 extend from the bit centerline a distance slightly smaller than the radial distance cut by cutting elements 26' extending the greatest radius from centerline CL.

As illustrated, both the gage pads 28 and the cutting elements 26 extend from the bit body 11 of the bit 10 such that the gage definition portion 30 continues to cut as the gage pads 28 wear. Moreover, the cutting elements 26 provide cutting action until they wear to such extent that an undergage wellbore is being cut, at which point the bit may be tripped. Thus, as the bit 10 is rotated into a formation, the gage definition region 30 actively assists in cutting and maintaining the gage diameter of the borehole such that the slick gage region 32 is always afforded adequate clearance and is thus far less likely to impede the ROP of the drill bit 10.

Another advantage of employing a gage definition region with cutting elements arranged according to the invention is to compensate for wear of radially outermost face cutters 20', so that as such face cutters 20' are worn, the cutters 26 and 26' of gage definition region 30 become engaged with the formation being drilled and so maintain a desired minimum gage diameter of the wellbore. In such a design, the radially outermost cutters 20' may be placed so that, as they wear, the radially outermost cutters 26' of the gage definition region are first to engage the wellbore sidewall, with other cutters 26 therebelow engaging the sidewall as further wear occurs in cutters 20' and cutters 26' begin to wear.

As illustrated in the following embodiments, the gage area of the drill bit may include many variations and combinations thereof and be within the spirit of this invention. For example, in FIG. 3, the gage area of the drill bit 210 may comprise in its entirety a gage definition region 230 including a plurality of cutting elements 226 helically arranged about the perimeter of the gage definition region 230 to substantially match the helical path or range of paths (depending on rotational speed and ROP) of the cutting elements 226 as they are rotated into a formation. As shown, the cutting elements 226 are larger than those depicted in FIG. 2, as are the slots 236. The helical arrangement of the cutting elements 226 may be a constant pitch helix as shown or a variable-pitch helix such that the angle of the helix increases from one end of the gage definition region 230 to the other. Such a helical arrangement of cutting elements 226 can thus accommodate different rotational speeds and ROPs of the drill bit 10. A helical arrangement in an oppositely-variable (decreasing) pitch configuration could also be beneficial. While helically arranged cutting elements 226 may be preferred, the important feature of any arrangement of cutters is that the cutting elements provide sufficient overlap in their respective paths and be of sufficiently-close radial placement (as defined at their radially outermost edges) to nibble away at the formation until the gage diameter is reached. Thus, any configuration of a plurality of rotationally overlapping cutters arranged to take a series of small-depth cuts outwardly from the face of the bit would provide the desired gradually expanding gage diameter effect. It should be noted that in this embodiment, the drill bit 210 also includes a plurality of face cutters 38 positioned around the face 218 of the bit 210. The cutting elements 226 on gage definition region 330 assist the face cutters 38 by incrementally cutting the desired borehole gage diameter and thus reduce the tangential loading experienced by the outermost face cutters 38' to an acceptable level.

Figure 4:
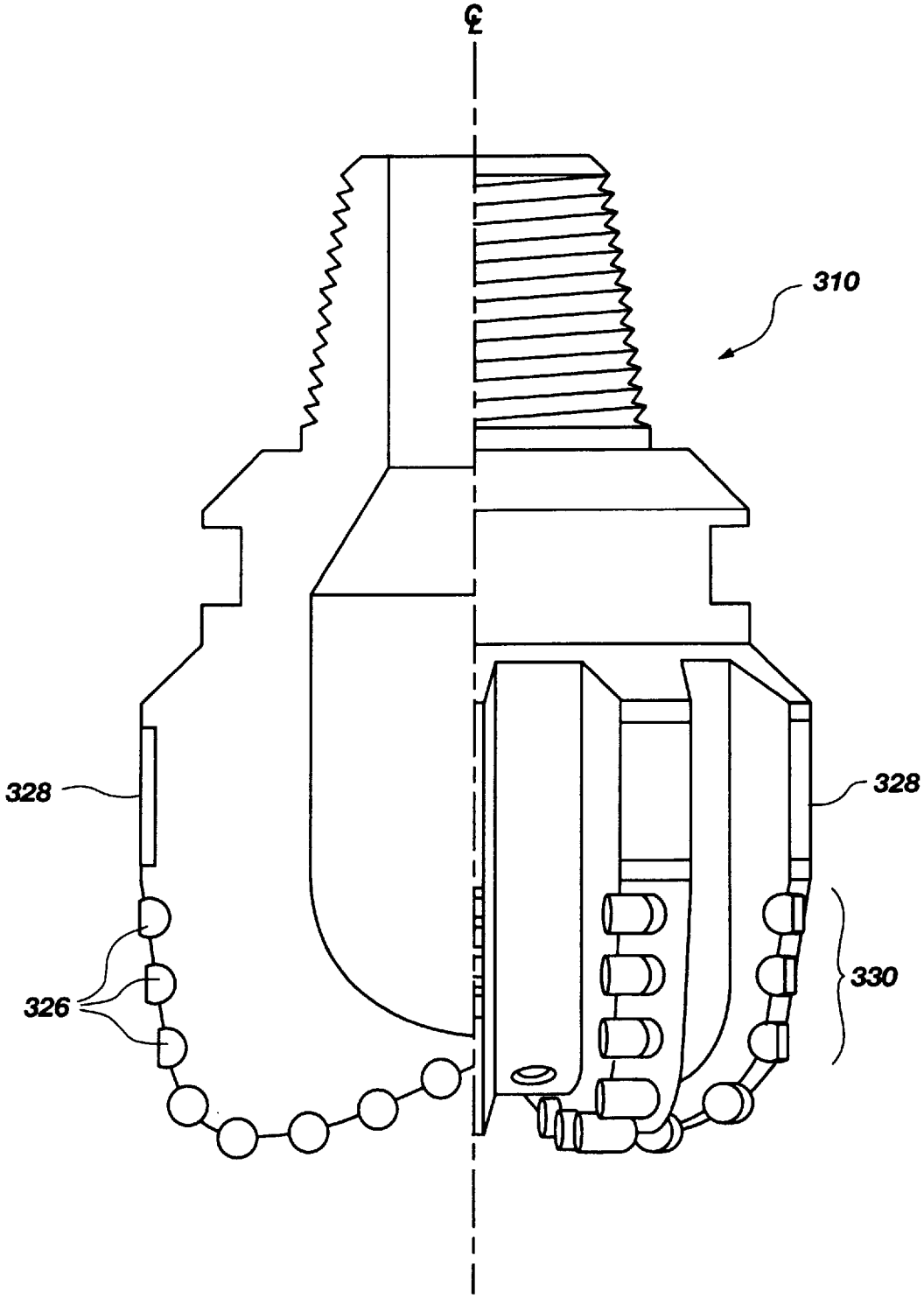
FIG. 4 is a part cross-sectional/part side view of a third embodiment of a drill bit in accordance with the present invention.

FIG. 4 is similar to the bit 10 depicted in FIG. 2 but illustrates a more conventional-looking cutter configuration. In this preferred embodiment, the cutters 326 of the gage definition region 330 are configured as what conventionally are termed "gage cutters." That is, they each have a flat side 327 which, in the art, would be used to precisely cut the gage diameter of the wellbore. In this embodiment, however, the flat sided cutters 326 are radially spaced from the bit 310 centerline so that their flat sides gradually increase in radial distance from the bit 310 centerline from each cutter to its immediately following cutter until the desired gage diameter is achieved. As further illustrated, the slick gage region may be comprised of a plurality of longitudinally-spaced gage pads 328. Additionally, the cutting elements 326 of the gage definition region 330 are positioned between the gage pads 328 and the face cutters 320. Typically, the gage pads 328 will be comprised of a less abrasion-resistant material than the cutting elements 326, so that cutting elements 326 will always cut a larger diameter wellbore than the diameter defined by gage pads 328.

Figure 3:
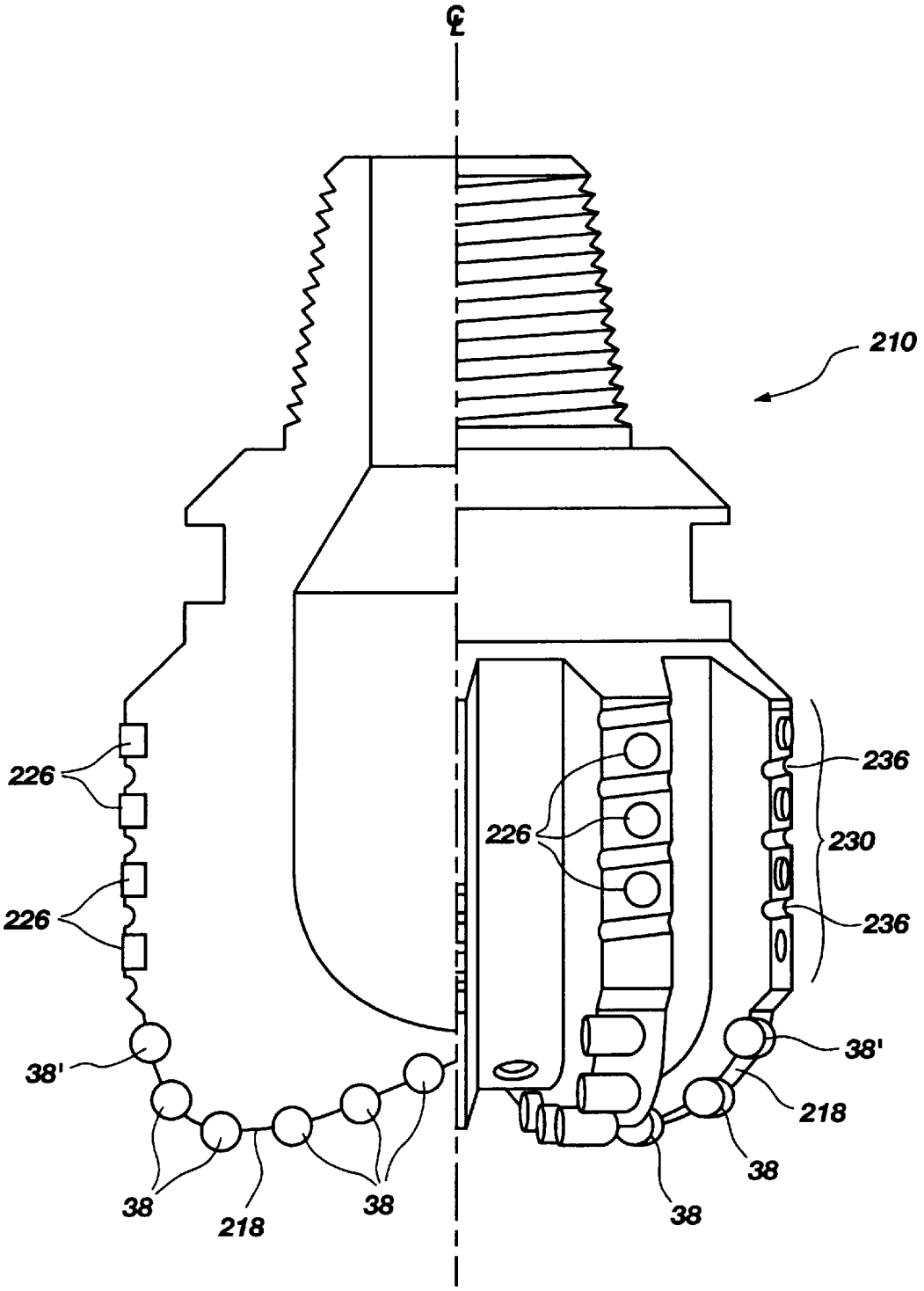
FIG. 3 is a part cross-sectional/part side view of a second embodiment of a drill bit in accordance with the present invention.
Figure 5A:
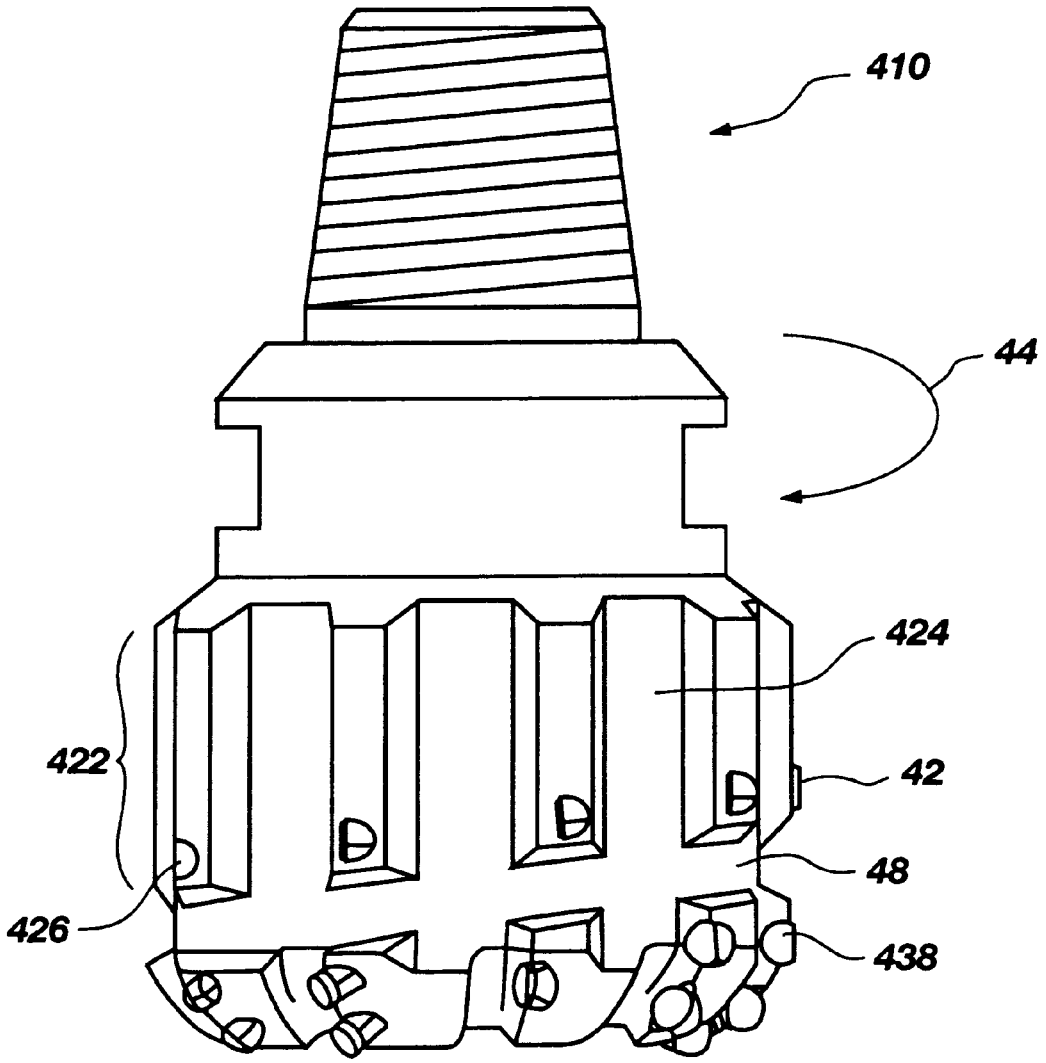
FIG. 5A is a side view of a fourth embodiment of a drill bit in accordance with the present invention.
Figure 5B:
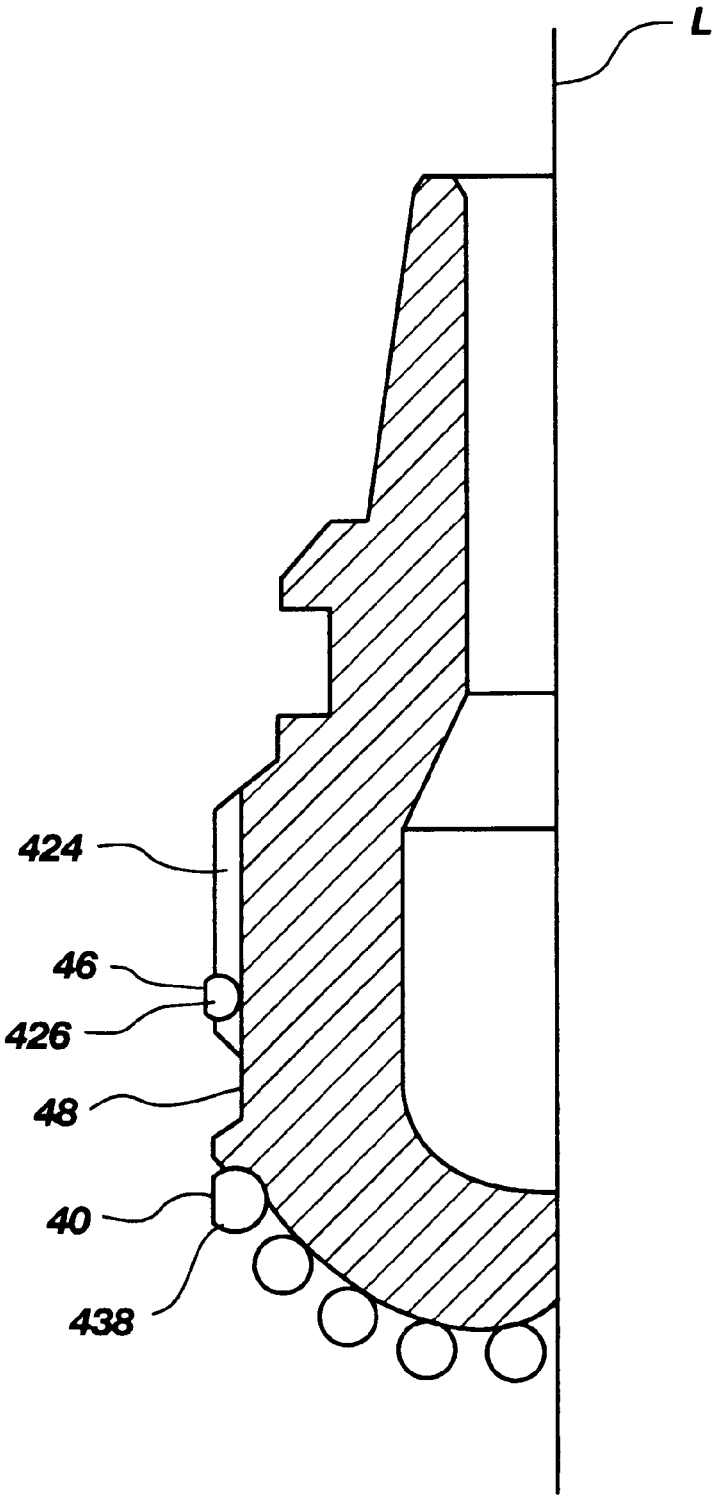
FIG. 5B is a partial cross-sectional view of the drill bit shown in FIG. 5A.

As shown in FIGS. 5A and 5B, gage definition elements (cutters) 426 may be placed along a helix relative to the longitudinal axis L (see FIG. 5B) of the bit 410 as shown in FIG. 5A such that a cutting face 42 of each cutting element 426 is somewhat radially oriented and faces substantially toward the direction of rotation of the bit, indicated by arrow 44. As shown in FIG. 5B, the cutting element 426 may be partially cylindrical, with a flat or linear edge portion 46 similar to edge 40 of gage cutter 438 therebelow. The cutting elements 426 may be oriented at any back rake angle between 0° (circumferentially), as shown in FIG. 3, and 90° (radially), as shown in FIG. 5A. Further, the cutting elements 426 may be oriented at any suitable side rake angle relative to the longitudinal axis of the bit 410. The gage 422 of the drill bit 410 may also include a substantially helical slot 48, as well as junk slots 424 or any combination thereof, to allow cuttings and drilling fluid to pass through the gage region 422 of the drill bit 410. It should also be noted that cutters 426 may be tilted into or away from the helix angle about their horizontal axes, instead of merely having their cutting faces 42 oriented parallel to the longitudinal bit axis. Additionally, the cutting elements 426 may have a rake angle adjusted according to the computed effective rake angle for a given ROP of the bit 410, the effective rake angle being determined by adding the angle of the helical path of the cutter 426 into the formation relative to the horizontal to the apparent rake angle of the cutter 426. For example, if the cutting surface 42 of cutter 426 has an apparent angle of inclination relative to a radially extending plane through the cutting face 42 of approximately 86° (i.e., 4° negative rake) and the helical path of the cutter 426 has an angle of inclination relative to horizontal of 4°, then the cutting face 42 has an effective angle of inclination, or effective rake, of precisely 90° and will be neither negatively nor positively raked.

It should also be recognized that the radial position of the cutter 426 relative to the centerline of the bit is determinative as to the effective rake angle. That is, the closer a cutter is positioned to the bit center, the greater the angle of inclination of the helical path relative to the horizontal for a given rotational speed and ROP, and the greater the apparent negative rake of the cutter must be to obtain an effectively more positive rake angle.

Figure 6:
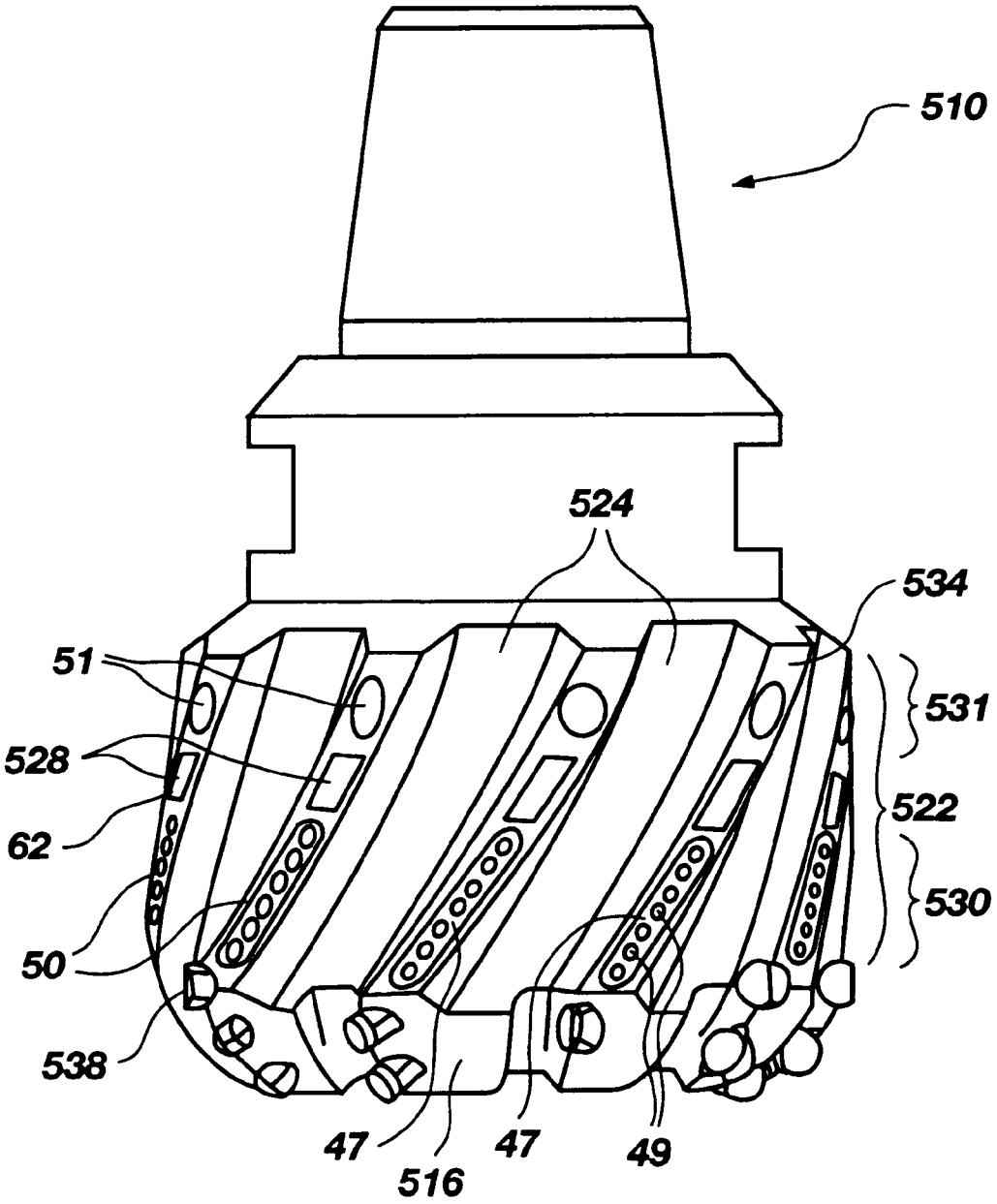
FIG. 6 is a schematic view of a fifth embodiment of a drill bit in accordance with the present invention.

In FIG. 6, gage 522 may comprise two gage definition regions 530 and 531, respectively, including a plurality of broached cutting elements 50 and cutting elements 51. The broached cutting elements 50 are basically individual or free-standing natural or synthetic diamonds 49 arranged in a row and inset and secured into an insert 47 possibly made of tungsten carbide, brass, tungsten or steel. In addition, the radially extending gage portions 534 may be helically configured, in this exemplary embodiment a relatively steep helix, about the perimeter of the gage 522 defining similarly helically configured, intervening junk slots 524. The broached cutting elements 50 are preferably angled and set relative to the exterior surfaces 62 of the gage pads 528 to form an inward frustoconical taper along the gage definition region 530 toward the leading end 516 of the bit 510, thus increasing the gage diameter of the bit 510 from the radially outermost face cutters 538 to the gage pads 528. As will be understood by those skilled in the art, such an angled gage definition region 530 could be incorporated into any of the embodiments described herein.

Figure 7:
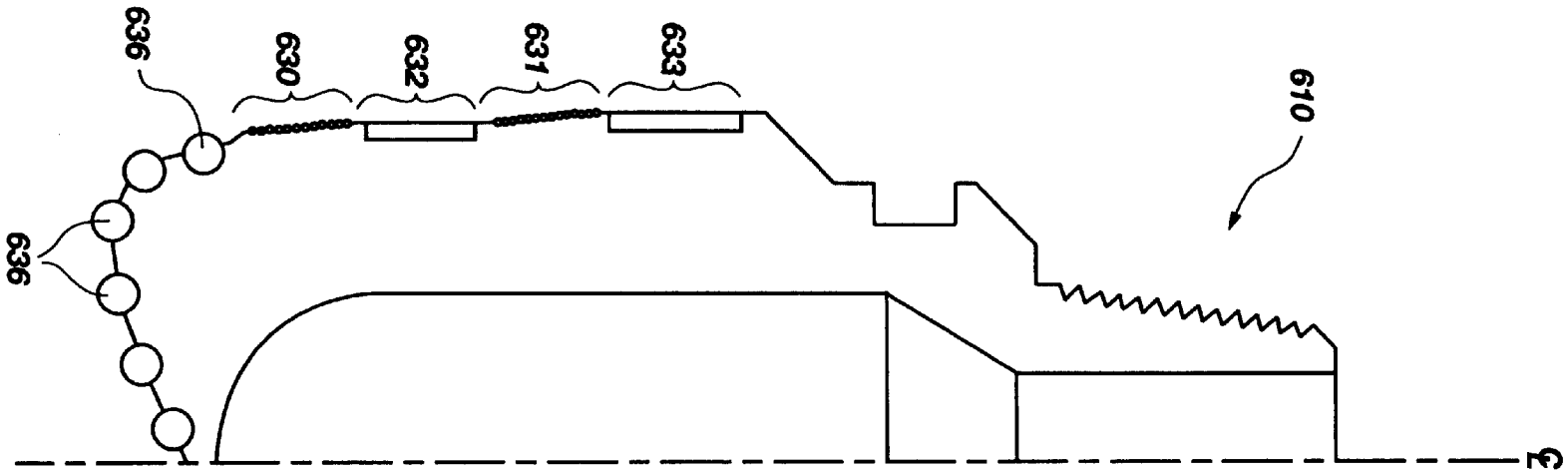
FIG. 7 is a partial cross-sectional view of a sixth embodiment of a drill bit in accordance with the present invention.

As further illustrated in FIG. 7, a bit 610 may include multiple gage definition regions 630 and 631 and multiple slick gage regions 632 and 633 to provide a multi-stage cutting bit 610. Accordingly, during drilling, the face cutters 636 cut the wellbore to a substantial percentage of the gage diameter. The first gage definition region 630 then removes a relatively small amount of the wall of the wellbore, through which the first slick gage region 632 can pass. The second gage definition region 631 engages and removes a relatively small amount of the formation until the second slick gage region can pass therethrough. Such an arrangement may be particularly suitable for drilling long, linear wellbore intervals through hard formations while minimizing vibration and whirl tendencies of the bit. If desired, it is possible to configure the entire bit crown to comprise one elongated gage definition region or a series of progressively larger gage definition regions extending from a very small group of nose cutters at the centerline of the bit, omitting the traditional bit "face" and resulting in a tapered, generally conical bit crown. Slick gage regions may be located between gage definition regions of a series, if desired, or recesses may be employed therebetween, or both slick gage and recessed regions used.

Figure 8:
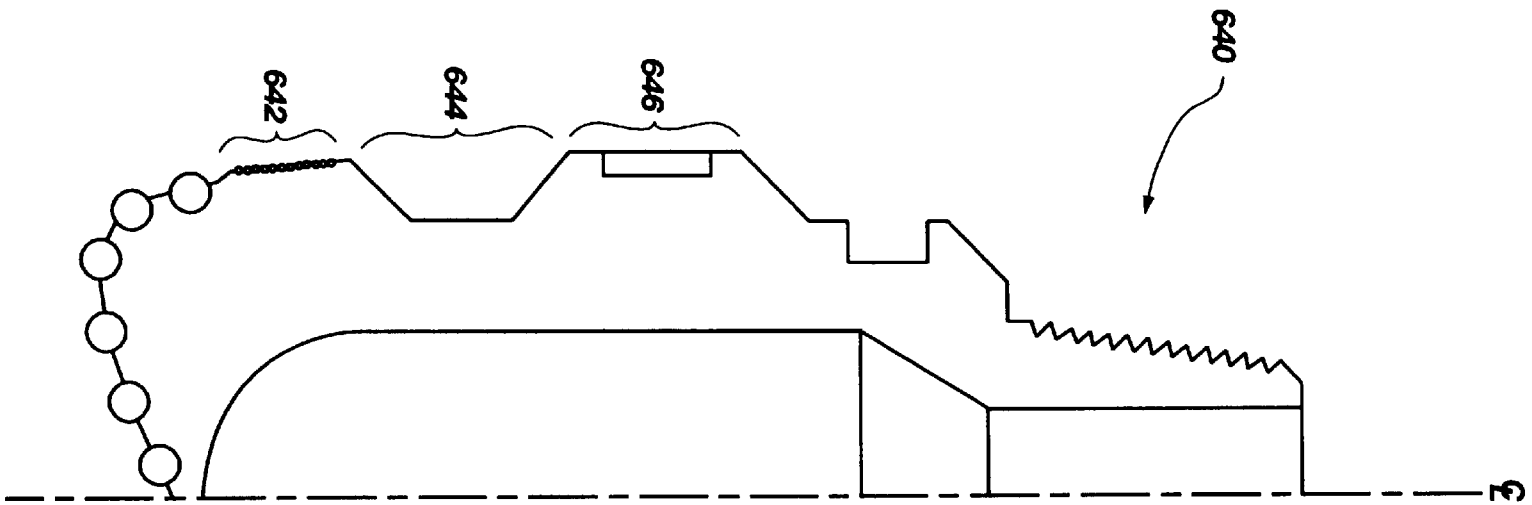
FIG. 8 is a partial cross-sectional view of a seventh embodiment of a drill bit in accordance with the present invention.

Likewise, as illustrated in FIG. 8, a gage definition region 642 of a bit 640 may be followed by a gage recess 644 which is followed by a slick gage region 646. Such a gage configuration may be particularly desirable for steering drill bits where the fulcrum of the bit is effectively moved to the slick gage region 646.

Figure 9:
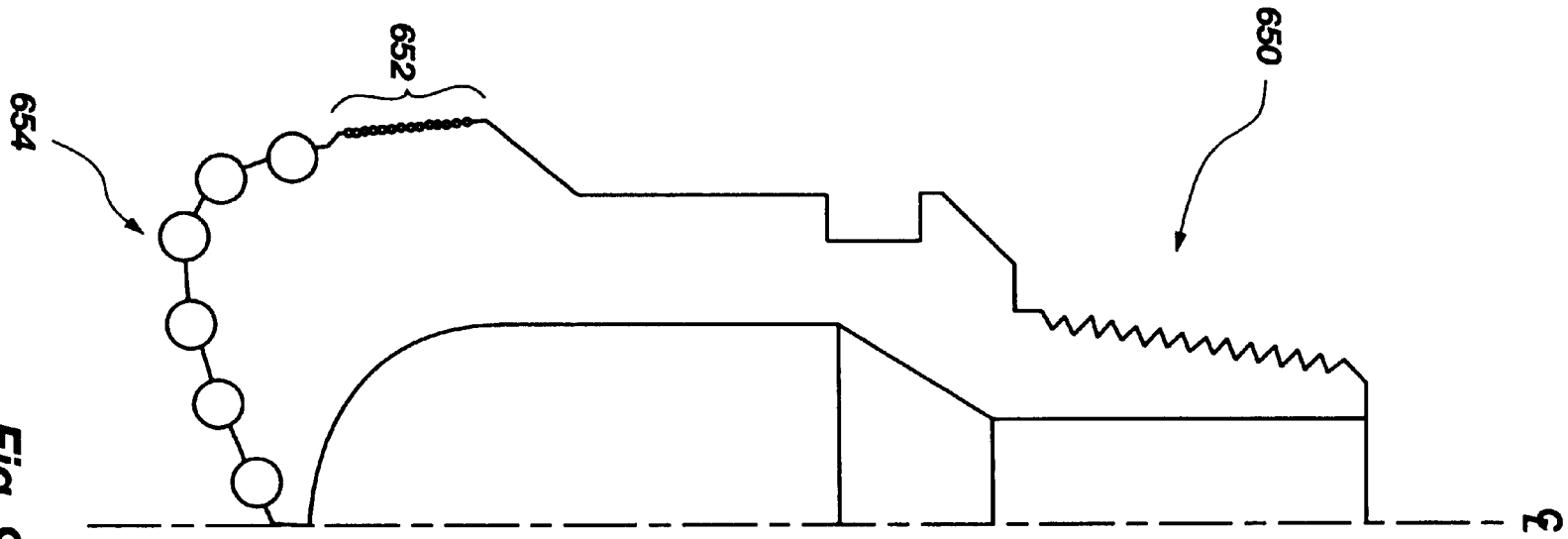
FIG. 9 is a partial cross-sectional view of an eighth embodiment of a drill bit in accordance with the present invention.

As further illustrated in FIG. 9, the portion of the bit 650 conventionally termed a "gage" is not included. Accordingly, the gage definition region 652 provides the only contact above the bit face between the wellbore wall and the bit 650 during drilling. Such a bit 650 would be highly steerable and particularly suitable for short-radius directional drilling, as the bit could effectively pivot about the crown 654.

Figure 10:
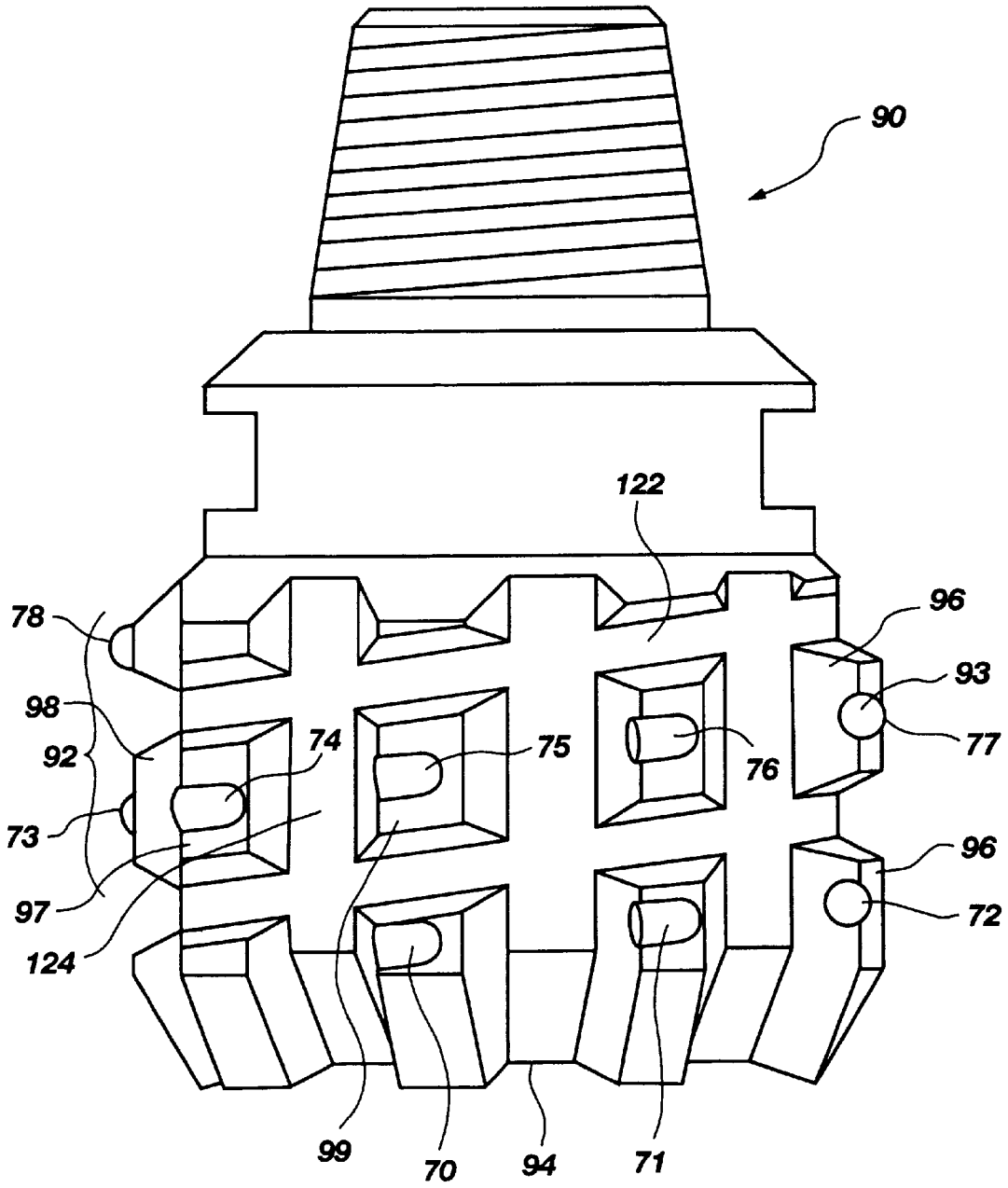
FIG. 10 is a side view of an ninth embodiment of an drill bit in accordance with the present invention.

As illustrated in FIG. 10, cutting elements 70–78 are helically arranged around the gage definition portion 92 of the bit 90 such that the gage definition portion 92 is substantially a cutting gage without conventional gage pads thereon. In addition, as can be observed by examining cutting elements 72 and 77, cutting element 72 which is closer to the leading end 94 of the bit 90 is radially inset into the blade 96 substantially more than the cutting element 77. While not as easily seen between adjacent cutting elements, those closer to the leading end 94 are inset slightly more into their respective blade than the next adjacent (following) cutting element. For example, cutting element 74 radially protrudes from its blade 97 slightly more than cutting element 73 from its blade 98. Similarly, cutting element 75 radially extends from its blade 99 slightly more than cutting element 101, and so on. Such an arrangement of cutting elements 70–78 in effect provides a varying diameter helix, or spiral, in which each successive cutting element in the helix cuts a little more from the formation than its preceding cutting element, thus "nibbling" the formation material and minimizing loading on each of the cutters. The amount of formation "seen" by each cutting element can be controlled, depending on the inset of each cutting element relative to the preceding cutting element in the helix. Accordingly, the forces and stresses applied to each cutting element can also be controlled by controlling the exposure of each cutting element to the formation upon rotation of the bit 90.

While insetting each cutting element a different distance into the bit is one way of achieving a varying diameter helix of cutting elements, the same effect can be achieved by varying the diameter of the exterior surface of the blades of the bit. It is also contemplated, as shown in FIG. 2, that varying sizes of cutting elements could also achieve the same diametric effect by following smaller cutting elements by successively larger ones, or that equal-diameter cutting elements may have flats trimmed to different sizes to vary the diameter of cut. This approach, effected after the cutters are mounted on the bit, could achieve very precise dimensional control of the various portions of the gage definition region according to the present invention. In addition, as previously mentioned, while the cutting elements are shown in various helical arrangements, any overlapping relationship of the cutting elements upon rotation of the bit could produce the desired gradual cutting action of the gage definition region.

In addition to the cutting elements 70–78 being helically arranged, it may also be desirable to provide helically configured junk slots 122 in addition to conventional vertical junk slots 124. These additional helically configured junk slots 122 will aid in removing debris from around the bit 90 and from the face 93 of each cutter 70–78, and allow a greater volume of drilling fluid to circulate around the bit 90 and thus enhance cooling of the cutters 70–78.

Figure 11:
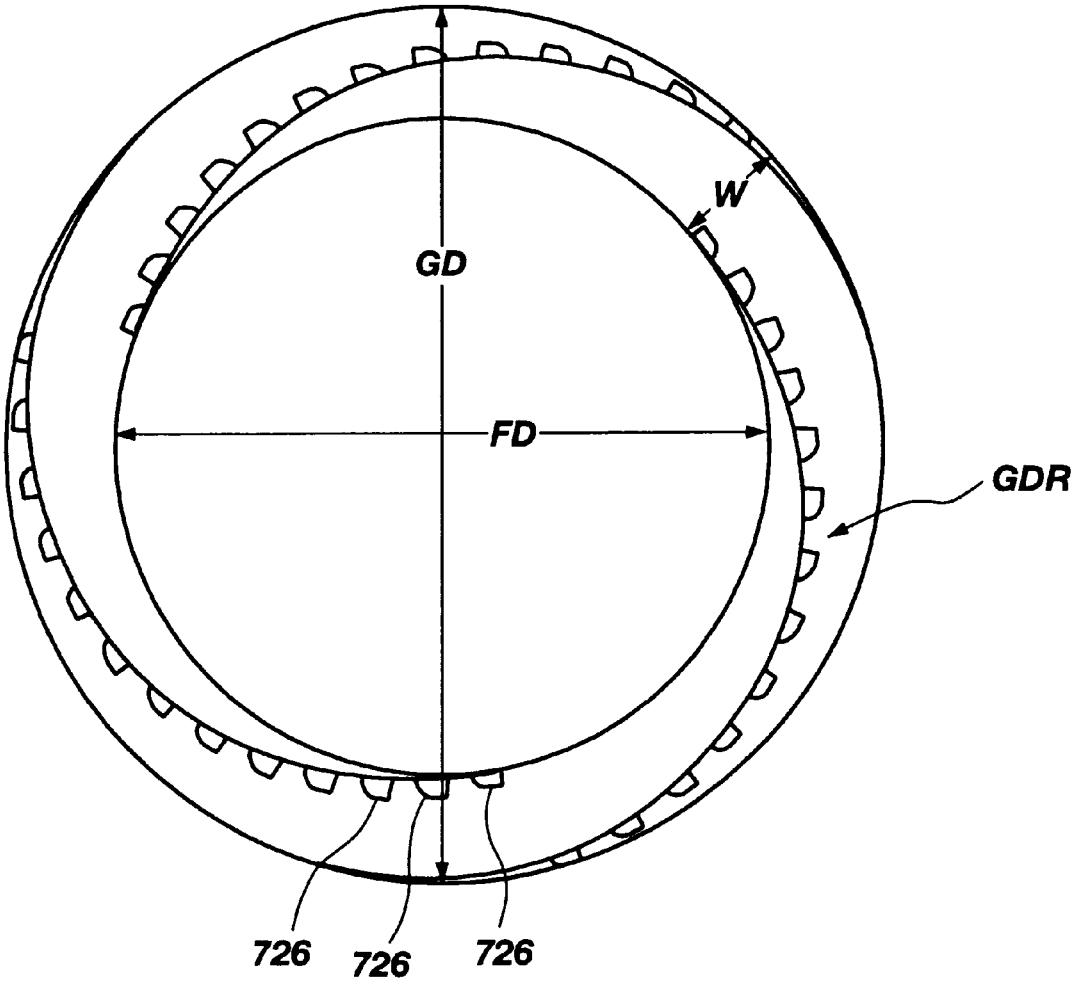
FIG. 11 is a schematic view from the underside of the bit, depicting a helical multi-lead gage definition region or portion according to the present invention.
Figure 12:
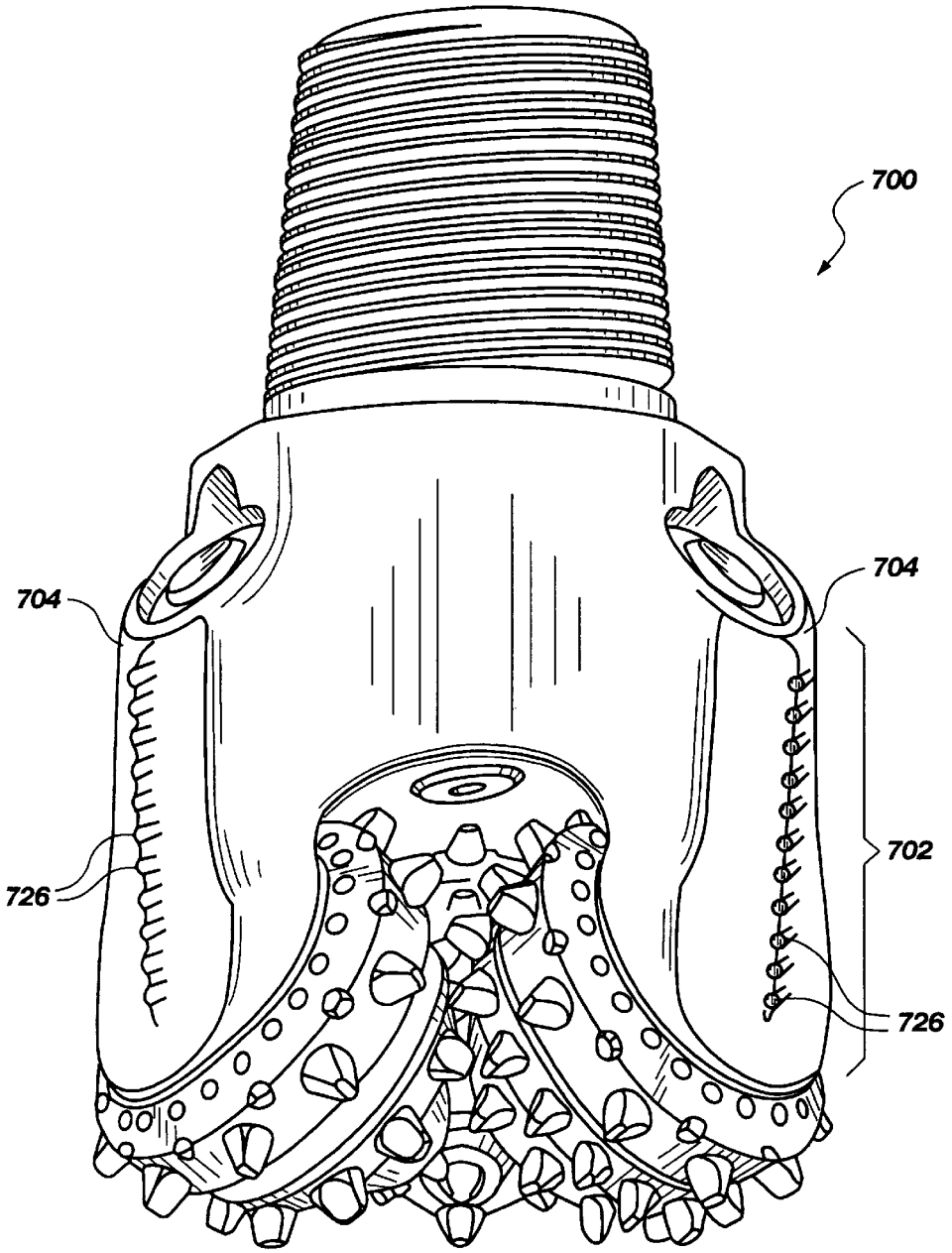
FIG. 12 is a side elevation of a tri-cone bit employing a gage definition region.

As previously noted, the gage definition region may be configured as a plurality of redundant helices, with two or three cutting elements circumferentially spaced about the bit at a smaller entry diameter slightly larger than the face diameter, each of the two or three circumferentially-spaced cutting elements being followed by a discrete series of cutters. Each helical series of cutters defines ever-larger diameters, cutter by cutter, until gage diameter is reached. Alternatively, a plurality of cutters may be placed to cut each incrementally larger diameter, although not configured in a helix. Ideally, and regardless of whether a helical cutter pattern is employed, there will be cutter redundancy at each incremental diameter. FIG. 11 schematically illustrates such redundancy from the underside of the bit, depicting three cutters 726 at each incremental diameter, but placed on one of three different helices, as shown. The width W of the gage definition region GDR has been exaggerated for clarity. Thus, it can be readily appreciated how the face diameter FD cut by the bit face is enlarged to the gage diameter GD of the wellbore in a controlled, non-destructive manner according to the invention.

What is claimed is:

1. A rotary drill bit for drilling wellbore in a subterranean formation, comprising:

a bit body having a leading end with a face and a trailing end;

a cutting structure mounted on said face and including a plurality of face cutters mounted on said face; and at least one gage definition region longitudinally extending from proximate said plurality of face cutters toward said trailing end, said at least one gage definition region defining a larger diameter at its trailing longitudinal extent than at its leading longitudinal extent and including a plurality of cutters disposed thereon to form at least one variable-pitch helix arranged to substantially match a range of predicted helical paths of cutters of said at least one gage definition region into a formation attributable to rotation and longitudinal advance of said drill bit in drilling of said wellbore.

2. The drill bit of claim 1, wherein said cutters of said plurality each define a cutting edge, wherein cutting edges of cutters closer to said trailing end are positioned a greater radial distance from a longitudinal axis of said bit than cutting edges of cutters closer to said leading end.

3. The drill bit of claim 1, wherein said plurality of cutters of said at least one gage definition region includes a plurality of cutting edges defining a longitudinally-extending perimeter, said perimeter substantially forming a frustoconical taper.

4. The drill bit of claim 1, wherein said plurality of face cutters is positioned to substantially cut said wellbore to a first diameter and said plurality of cutters on said at least one gage definition region are positioned to relatively gradually enlarge the wellbore first diameter.

5. The drill bit of claim 1, wherein said at least one gage definition region lies at an acute angle relative to a longitudinal axis of said bit.

6. The drill bit of claim 1, wherein a radius of said at least one varaible-pitch helix, taken from a centerline of said bit, increases from said leading end toward said trailing end.

7. The drill bit of claim 1, wherein said cutters of said plurality of cutters of said at least one gage definition region each include a cutting face oriented at a selected rake angle relative to said bit body to produce a desired effective rake angle upon rotation of said drill bit into a formation at a given rotational speed and rate of penetration.

8. The drill bit of claim 7, wherein said selected rake angle is between 0° and 90°.

9. The drill bit of claim 1, wherein said at least one gage definition region further includes a plurality of junk slots substantially longitudinally extending from said face of said bit body through at least a portion of said at least one gage definition region.

10. The drill bit of claim 9, wherein said plurality of junk slots and said plurality of cutters are helically arranged about said at least one gage definition region.

11. The drill bit of claim 1, wherein said cutters of said plurality on said at least one gage definition region are comprises of at least one material selected from the group comprising: PDC, TSP, cubic boron nitride, natural diamond, and synthetic diamond grit.

12. The drill bit of claim 1, further including at least one slick gage portion in said at least one gage definition region.

13. The drill bit of claim 12, wherein said at least one slick gage portion is at least partially formed of a less abrasion resistant material than said at least one gage definition region cutters.

14. The drill bit of claim 13, wherein said at least one slick gage portion includes a plurality of wear inserts.

15. The drill bit of claim 1, further including an additional portion of said bit body above said at least one gage definition region and of lesser diameter than said trailing longitudinal extent of said at least one gage definition region.

16. The drill bit of claim 1, wherein said at least one gage definition region includes a plurality of longitudinally-separated cutting gage portions.

17. The drill bit of claim 1, wherein said at least one gage definition region includes at least one broached gage portion.

18. The rotary drill bit of claim 1, further including at least one slick gage region interposed longitudinally between two gage definition regions.

19. The rotary drill bit of claim 1, further including at least one circumferentially-extending recess interposed longitudinally between two gage definition regions.

20. The rotary drill bit of claim 1, wherein said rotary drill bit is a rolling cone bit.

* * * * *